US008132440B2

(12) United States Patent
Cooper

(10) Patent No.: US 8,132,440 B2
(45) Date of Patent: Mar. 13, 2012

(54) ROLL BENDING DEVICE

(75) Inventor: Brian Cooper, Sheffield (GB)

(73) Assignee: Siemens VAI Metals Technologies Ltd. (GB)

( * ) Notice: Subject to any disclaimer, the term of this patent is extended or adjusted under 35 U.S.C. 154(b) by 944 days.

(21) Appl. No.: 12/088,905

(22) PCT Filed: Sep. 26, 2006

(86) PCT No.: PCT/EP2006/009334

§ 371 (c)(1),
(2), (4) Date: Apr. 1, 2008

(87) PCT Pub. No.: WO2007/042142

PCT Pub. Date: Apr. 19, 2007

(65) Prior Publication Data

US 2008/0250834 A1 Oct. 16, 2008

(30) Foreign Application Priority Data

Oct. 10, 2005 (EP) ..... 05256303

(51) Int. Cl.
*B21B 31/32* (2006.01)

(52) U.S. Cl. ..... 72/245

(58) Field of Classification Search ..... 72/245, 72/246, 247, 241.8
See application file for complete search history.

(56) References Cited

U.S. PATENT DOCUMENTS

| | | | | |
|---|---|---|---|---|
| 4,967,582 | A | 11/1990 | Bohnenkamp | |
| 5,090,228 | A * | 2/1992 | Schmiedberg et al. | 72/245 |
| 5,195,346 | A * | 3/1993 | Braun et al. | 72/245 |
| 6,112,569 | A | 9/2000 | Ossendorf | 72/241.8 |
| 6,164,111 | A | 12/2000 | Langeder | |
| 6,993,951 | B1 * | 2/2006 | Sudau et al. | 72/245 |
| 7,895,871 | B2 * | 3/2011 | Zieser et al. | 72/245 |
| 2007/0129228 | A1 | 6/2007 | Zieser et al. | |
| 2011/0132055 | A1 * | 6/2011 | Diehl et al. | 72/245 |

FOREIGN PATENT DOCUMENTS

| | | |
|---|---|---|
| DE | 38 07 628 | 9/1989 |
| DE | 196 20 704 | 6/1997 |
| DE | 199 38 217 | 4/2000 |
| DE | 103 34 682 | 2/2005 |
| EP | 0 256 408 | 2/1988 |

(Continued)

OTHER PUBLICATIONS

International Search Report dated Dec. 22, 2006 issued in corresponding PCT Application No. PCT/EP2006/009334.

*Primary Examiner* — Dana Ross
*Assistant Examiner* — Mohammad I Yusuf
(74) *Attorney, Agent, or Firm* — Ostrolenk Faber LLP

(57) ABSTRACT

The invention relates to a roll bending device for the control of profile and flatness in the rolling of metal plates or strips. In particular the invention relates to the well known principle of roll bending by using hydraulic cylinders to modify the load distribution between rolls of a rolling mill stand and a rolled stock e.g. a metal plate or a strip in order to control the profile and flatness of the metal plate or strip. A special design to allow safe roll bending even at large roll gauges is presented. The new design allows safe operation even at large roll gauges and high side loads.

21 Claims, 6 Drawing Sheets

FOREIGN PATENT DOCUMENTS

| | | |
|---|---|---|
| EP | 0 256 410 | 2/1988 |
| EP | 0 340 504 | 11/1989 |
| EP | 1 087 849 | 8/2002 |
| EP | 1 181 114 | 3/2003 |
| EP | 1 500 442 | 1/2005 |
| JP | 60 206508 | 10/1985 |
| JP | 1-138010 | 5/1989 |
| WO | WO 2007/121832 | 11/2007 |

* cited by examiner

ROLL BENDING DEVICE

CROSS REFERENCE TO RELATED APPLICATION

The present application is a 35 U.S.C. §§371 national phase conversion of PCT/EP2006/009334, filed Sep. 26, 2006, which claims priority of European Application No. 05256303, filed Oct. 10, 2005. The PCT International Application was published in the English language.

BACKGROUND OF THE INVENTION

The invention relates to a roll bending device for the control of profile and flatness in the rolling of materials. In particular the invention relates to the well known principle of roll bending by using hydraulically actuated pistons to modify the load distribution between rolls of a rolling mill stand and a rolled material for example a metal plate or a strip in order to control the profile and flatness of the metal plate or strip. It is well known to apply bending to the work rolls of a rolling mill stand which might have an additional pair of backup rolls (4-high rolling mill stand) or additional pairs of backup and intermediate rolls (6-high rolling mill stand).

Furthermore the invention relates to a rolling mill stand with at least a pair of rolls pivoted in roll chocks and arranged in a mill stand housing and with at least one hydraulically actuated piston arranged in a bending block, for the bending of rolls, in order to allow control of profile and flatness in the rolling of metal strips or plates.

Typically, in systems known from prior art, hydraulic cylinders between work roll chocks, for the bearing of rolls in a rolling mill stand, are used to bend the work rolls in order to modify the profile and flatness of the rolled material.

In older prior art roll bending systems the hydraulic cylinders for the roll bending are built into either the work roll or the backup roll chocks. However, modern roll bending systems often use roll bending cylinders which are built into blocks, called roll bending blocks, which are attached to the mill stand housing. This type of system is preferred because the hydraulic connections can be permanently installed, they are generally capable of higher bending forces, and they are easier to maintain.

In addition to roll bending, many modern mills are equipped with roll shifting systems in which the work rolls can be axially shifted. By using work rolls with special profiles the axial shifting of the work rolls can be used to provide additional profile and flatness control capabilities.

In order to work with roll shifting, many modern roll bending systems are designed to work with the axial shifting of the work rolls. There are two main types of system in use. They are both designed to ensure that the roll bending force is applied to the centreline of the work roll bearing whatever the axial shift position of the roll might be. In one type the whole bending block containing the hydraulic cylinders is shifted axially together with the work rolls. In the other type the force is applied by a pair of bending cylinders and the distribution of load between the two cylinders is adjusted to keep the resultant total force centred on the bearing.

A fundamental problem with known roll bending block systems is the fact that especially with thick rolled material the top work roll chock loses the capability of support against side loads.

Some systems known from prior art also provide support where the work roll chock wing contacts the mill stand housing but this is not satisfactory due to the small area of contact. High stresses at the work roll chock wing and the difficulty of providing both good support for the chock and allowing enough clearance for axial shift of the rolls and for roll change are the disadvantages of this systems. As the side loads on the work roll chocks are high this problem is an important consideration for mills rolling thick material such as plate mills.

According to the known prior art, it is very difficult to achieve good support of the work roll chock when rolling thick material with existing bending block designs. Consequently many modern plate mills still use the older in-chock type of bending systems in order to be able to handle thick material.

SUMMARY OF THE INVENTION

It is an object of the present invention to overcome the problem of poor work roll chock support when rolling thick material with existing bending block designs and to allow the support of side loads.

According to the present invention a moving extension piece is added to the bending block in order to provide good support for the work roll chock even when rolling thick material. The extension piece assures even with large gauges the safe support of the roll chock by supporting side loads in a direction parallel to the rolled material. The extension piece transfers side loads from the roll chock onto the rolling mill stand and avoids side loads at the bending block and the piston of the bending block. The extension piece may follow the vertical movement of the roll chock and is guided between the roll chock and the mill stand housing.

According to a special embodiment of the present invention the extension piece is relocatable in a direction parallel to the axis of the piston of the bending block allowing in installed position transfer of bending forces from the roll bending block to a roll chock. Thus the extension piece supports the roll bending while protecting the piston and the bending block from side loads which could cause damages to the block. The bending block is able to work under all rolling conditions even under high side loads which cannot be avoided in normal rolling operation and the bending force generated by the bending block is transferred to the roll chock. The extension pieces can be attached to the bending block and thus can remain in the mill when the rolls are changed. This is a considerable advantage and allows quick roll change.

According to a preferred embodiment of the present invention the extension piece comprises a top part and side walls, whereas in installed position the sidewalls can be arranged parallel to the roll axes and are in contact with the roll chock and the mill stand housing. Due to the shape with a top part and sidewalls the extension piece allows contact with the sidewall of the roll chock and the mill stand housing. The top part assures the safe contact between the bending piston and the roll chock and accordingly with the wing of the roll chock even at high bending and side loads. An advantageous design is achieved with a cuboid-shaped (box-shaped) extension piece with a top part and four side walls assuring a very rigid extension piece allowing the safe transfer of high side loads without any damages to the bending block even when rolling thick material. Furthermore the extension piece can easily be removed for doing maintenance or in order to change the wear plates. A further advantage of the invention is the protection of the hydraulic pistons of the bending block from water and scale. This very important benefit allows a safe operation under the rough rolling conditions and therefore reduced maintenance.

According to an alternative embodiment of the present invention the sidewalls comprise at least one removably mounted wear plate, which can be brought in contact with at least one wear plate removably mounted at the roll chock and at the mill stand housing. Due to the rough rolling conditions the application of wear plates at contact areas allows the replacement of worn parts easily.

According to a possible embodiment of the present invention the top part comprises removably mounted wear plates, which can be brought in contact with the roll chock and the bending block. Due to the high loads and impact loads the contact surfaces have to be changed on a regular basis. The wear plates allow a cheap maintenance and the possibility to use high wear resistant plates.

According to a further preferred embodiment of the present invention the bending block comprises a thrust piece for the transfer of the roll bending force, generated by the piston, to the extension piece. The thrust piece makes sure that the bending force is transferred to the extension piece and the roll chock. The thrust piece is guided in the bending block and can be designed according to the application. Thus the length of the thrust piece in axial direction of the roll can be adjusted e.g. according to the axial shifting length of the roll in order to allow safe bending at all axial roll shifting positions.

In an embodiment of the present invention the thrust piece is connected to at least one piston. The thrust piece allows the use of more than one piston and therefore the application of roll bending forces even with large axial shifting lengths. In combination with the extension piece a very robust and reliable design is created.

According to a special embodiment of the present invention the thrust piece comprises a removably mounted wear plate for contacting the extension piece. For maintenance reasons replaceable wear plates are advantageous as special wear resistant materials can be applied and replacement is easily possible.

A preferred embodiment of the present invention is achieved when in installed position the roll and the extension piece can be arranged moveable in an axial direction. For the axial shifting of the roll the roll chocks are moving together with the roll. This means a changed position of the chock at which the bending force has to be applied in order to allow bending of the rolls. The extension piece can be arranged to allow axial movement together with the roll and the roll chocks. The bending block can be mounted at the mill stand housing in a fixed position. The relative position of contact of the bending block at the extension piece can be changed according to the axial position of the roll.

Alternatively the extension piece can be arranged fixed to the bending block, which is mounted at the mill stand housing. In this case the chocks can slide at the extension piece when axial shifting of rolls is applied.

According to an alternative embodiment of the present invention in installation the roll and the extension piece and the bending block can be arranged moveable in axial direction whereas the bending block comprises a guiding device for being guidable in axial direction. This concept allows that the bending force can act on the centreline of the work roll bearing independent of the axial roll shift position. A guiding device assures the safe axial displacement of the bending block.

According to a special embodiment of the present invention in installed position the bending block comprises two or more pistons and the bending force applied by the two or more pistons can be adjusted according to the axial position of the roll in order to keep the resultant total bending force centred on the roll chock. This solution allows a bending block mounted at the mill stand housing even with very long axial shifting of the roll. The fixed design assures a simple and robust hydraulic supply of the bending block. Due to the force adjustment a centred bending force can be applied and thus high loads due to non-centred loads or even increased wear can be avoided. This embodiment allows a simple design for the bending system even with long stroke axial shifting and when rolling thick material.

According to a preferred embodiment of the present invention in installed position each roll comprises two bending devices acting at each roll chock. The two bending devices are acting together and allow the application of bending loads at each roll chock keeping the roll chock in a symmetrical position. Therefore no side loads are introduced by the bending devices and optimized movement of the roll chocks in the mill stand housing are guaranteed. Due to the symmetrical design with respect to the roll axis side forces can be transferred to the rolling mill stand in both directions allowing the system to be used for reversing rolling operations also.

The present invention relates also to a rolling mill stand with at least a pair of rolls pivoted in roll chocks and arranged in a mill stand housing, with at least one hydraulically actuated piston arranged in a bending block, for the bending of rolls, in order to allow control of profile and flatness in the rolling of metal strips or plates. The roll bending device comprises at least one extension piece, guidable between a roll chock and the mill stand housing and being moveable with the roll chock, whereas the extension piece allows transfer of side loads from the work roll chock onto the mill stand housing. The rolling mill stand allows safe rolling even at large gauges (roll gap) and prevents damages to the bending block arising from side loads.

According to a special embodiment of the rolling mill stand the extension piece comprises a top part and at least two side walls, whereas the sidewalls are arranged parallel to the roll axes and are in contact with the roll chock and the mill stand housing. The guided contact allows movement of the extension piece and safe transfer of side loads. Due to the contact with the roll chock and the mill stand housing any side load can be transferred without creating overloads at the bending block.

According to an alternative embodiment of the rolling mill stand the sidewalls comprise at least one removably mounted wear plate, being in contact with at least one wear plate removably mounted at the roll chock and at the mill stand housing. The removable wear plates allow a quick maintenance of worn contact parts.

According to an advantageous embodiment of the rolling mill stand the top part comprises at least one removably mounted wear plate, being in contact with the roll chock and the bending block. All contact surfaces are protected by a removable wear plate thus maintenance is easily possible.

According to a preferred embodiment of the rolling mill stand the roll and the extension piece are arranged moveable in the mill stand housing in axial direction. This allows a safe bending operation and transfer of side loads even at different axial roll positions.

According to a possible embodiment of the rolling mill stand each roll comprises two bending devices acting at each roll chock. By using two bending devices safe transfer of side loads is achieved thus allowing safe rolling in different rolling directions.

In a special embodiment of the rolling mill stand the roll chock can slide at the extension piece in order to allow axial displacement of the roll. With this special embodiment it is possible to arrange the extension piece at the bending block, which can be fixed to the mill stand housing. Relative movement between the roll chock and the extension piece with the bending block allows axial shifting of the roll. This allows a very simple design.

The invention is described in more detail in the following figures presenting possible embodiments of the present invention without limiting the invention to the presented embodiments.

DESCRIPTION OF A PRIOR ART EMBODIMENT

Figure 1:
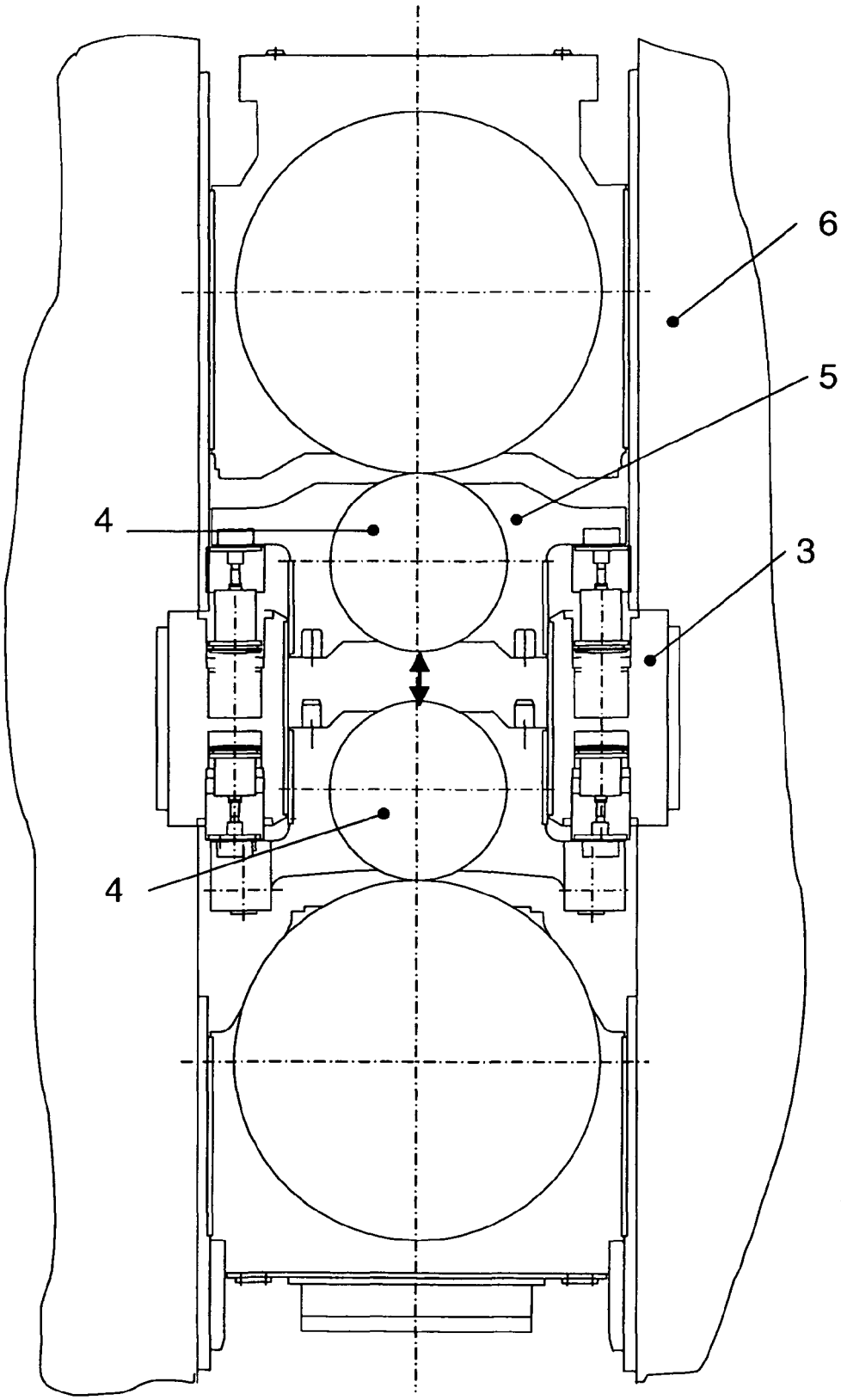
FIG. 1 is a sectional view of a 4-high rolling mill stand known from prior art.

The rolling mill stand depicted in FIG. 1 is known from prior art. The bending block is fixed at the mill stand housing (6) and is acting against the roll chocks (5) to allow bending of the rolls (4). Especially when thick material is rolled at large gauges the contact length between the roll chocks (5) at the bending block (3) is small. Thus, guiding of the roll chocks (5), especially when side loads occur, is not sufficient and damage may arise. This can cause serious damage or considerably increased maintenance efforts.

DESCRIPTION OF PREFERRED EMBODIMENTS

The rolling mill stand depicted in FIG. 1 is known from prior art. The bending block is fixed at the mill stand housing (6) and is acting against the roll chocks (5) to allow bending of the rolls (4). Especially when thick material is rolled at large gauges the contact length between the roll chocks (5) at the bending block (3) is small thus guiding of the roll chocks (5) especially when side loads occur is not sufficient and damages may arise. This can cause serious damages or considerably increased maintenance efforts.

Figure 2:
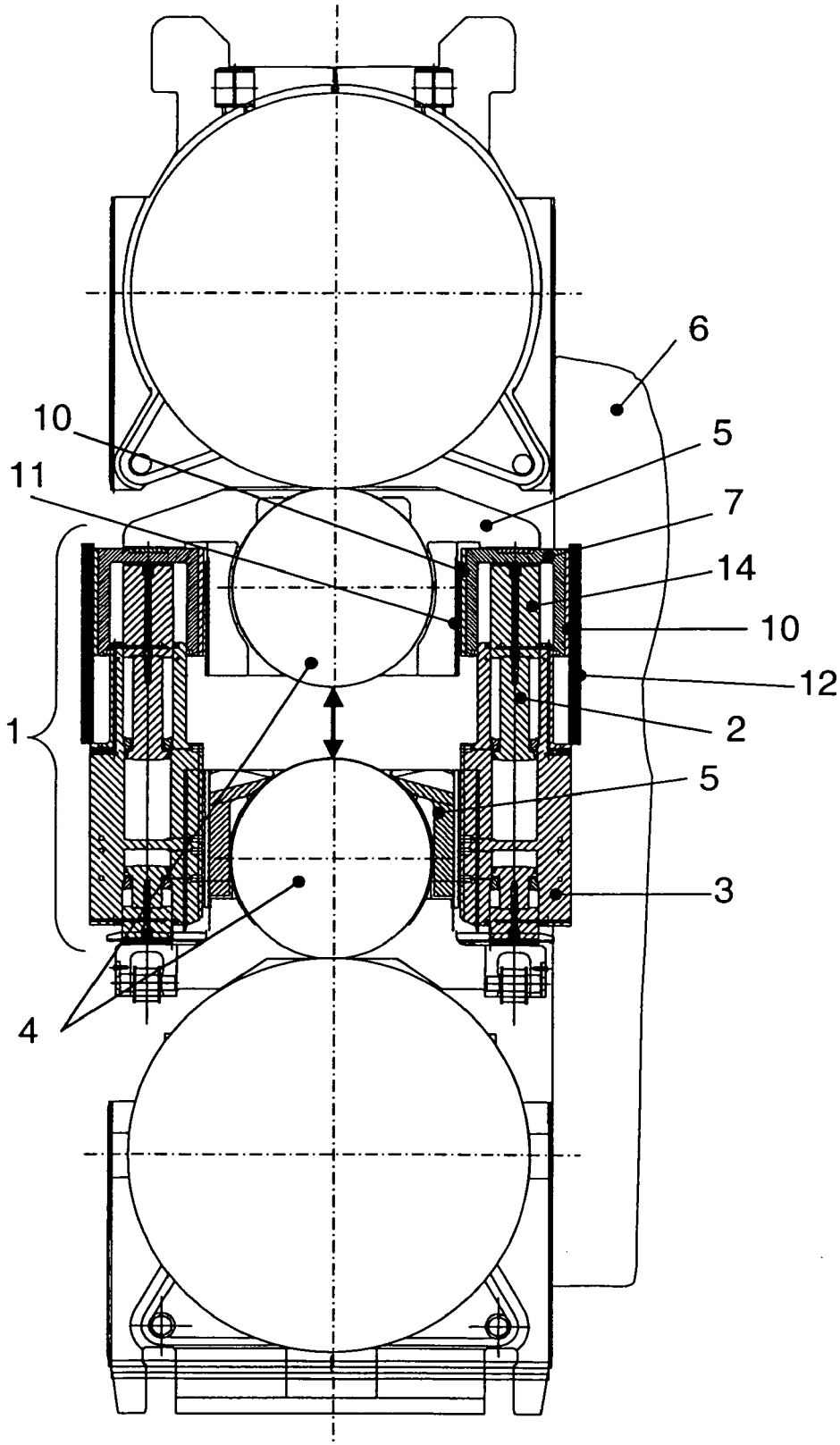
FIG. 2 is a sectional view of a 4-high rolling mill stand and the bending device according to the invention.

FIG. 2 shows a 4-high rolling mill stand with the bending device according to the invention. The bending block (3) can be fixed to the mill stand housing (6) and comprises at least one piston (2) which generates the bending force. The bending force is transferred to the roll chock (5) by means of the thrust piece (14) and the extension piece (7). The thrust piece (14) is connected to the piston (2). The extension piece can move up and down together with the thrust piece (14) and the roll chock (5) to allow bending at different rolling gauges.

The vertical face of the roll chock comprises a wear plate (11) which is in contact with the wear plate (10) of the sidewalls of the extension piece (7). On the other hand the extension piece (7) is in contact via wear plate (10) with the wear plate (12) mounted at the mill stand housing (6). Side loads are generated during rolling at the rolls and cause forces at the roll chocks (5). The extension piece (7) allows safe transfer of the side loads from the roll chock (5) to the mill stand housing (6) without creating such loads at the bending block (3) or the piston (2). The extension piece (7) is a rugged box-type construction and can thus easily withstand the side loads from the roll chock. The extension pieces (7) can be fixed to the thrust piece (14). Therefore during roll change the extension piece (7) can remain with the bending block (3) in the rolling mill stand. This allows a quick roll change. In case of axial roll shifting of the rolls (4) the roll chocks (5) may change their axial position and the point of contact with the extension piece (7) allowing roll bending at all axial shifting positions.

Figure 3:
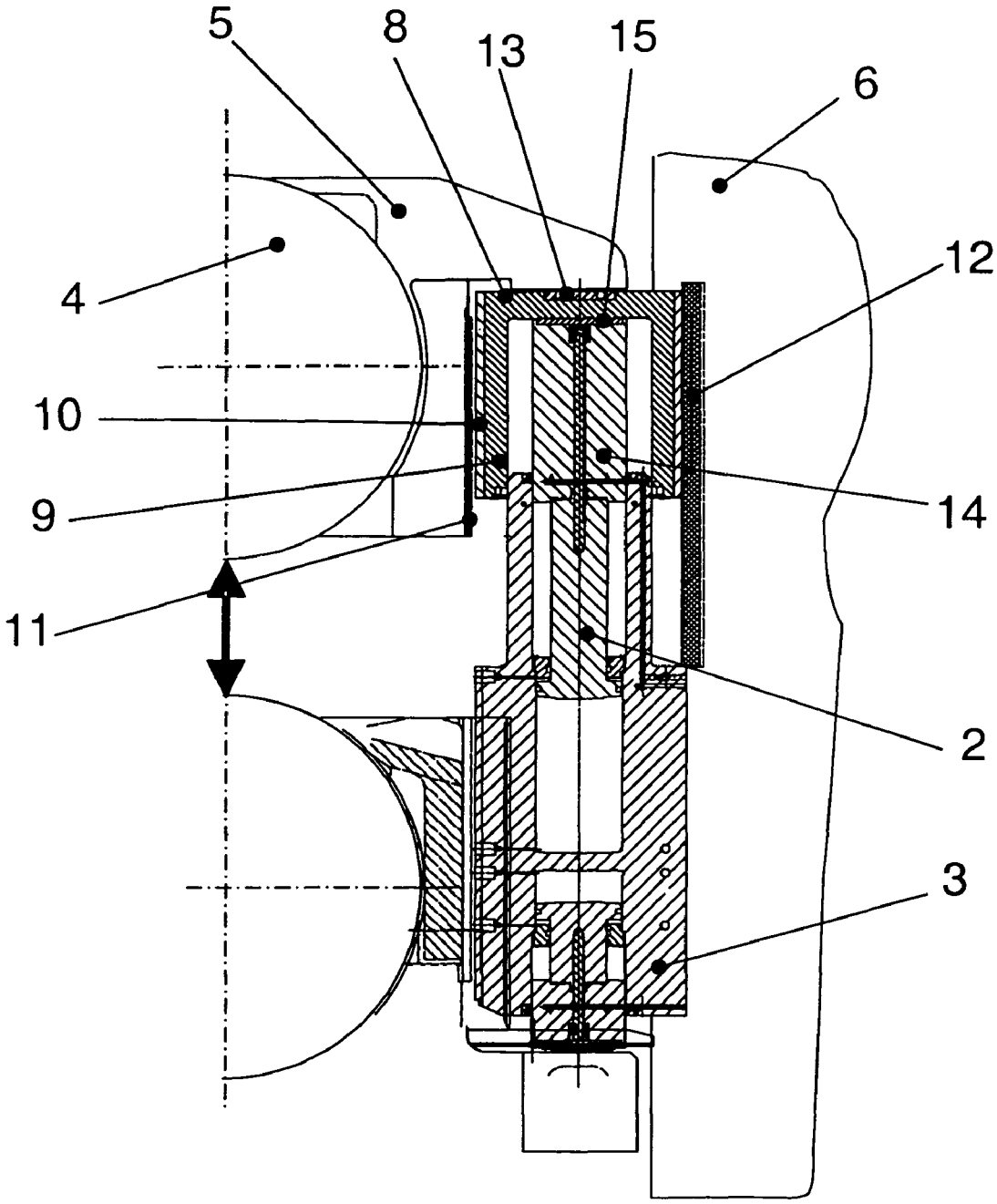
FIG. 3 is a sectional view of the bending device according to the invention.

FIG. 3 shows the bending device in more detail. All contact surfaces are protected with wear plates (10, 11, 12, 13) in order to allow quick change of worn wear plates and the possibility to choose the material in accordance with the special load situation. These contact areas have to withstand high loads and severe rolling conditions like water and scale. The piston (2) is arranged in the bending block (3) and is connected to the thrust piece (14). The extension piece (7) covers the bending block (3) and protects the bending block (3) from water and scale. Even at the largest possible rolling gauges safe guidance of the roll chocks (5) in rolling direction can be assured.

Figure 4:
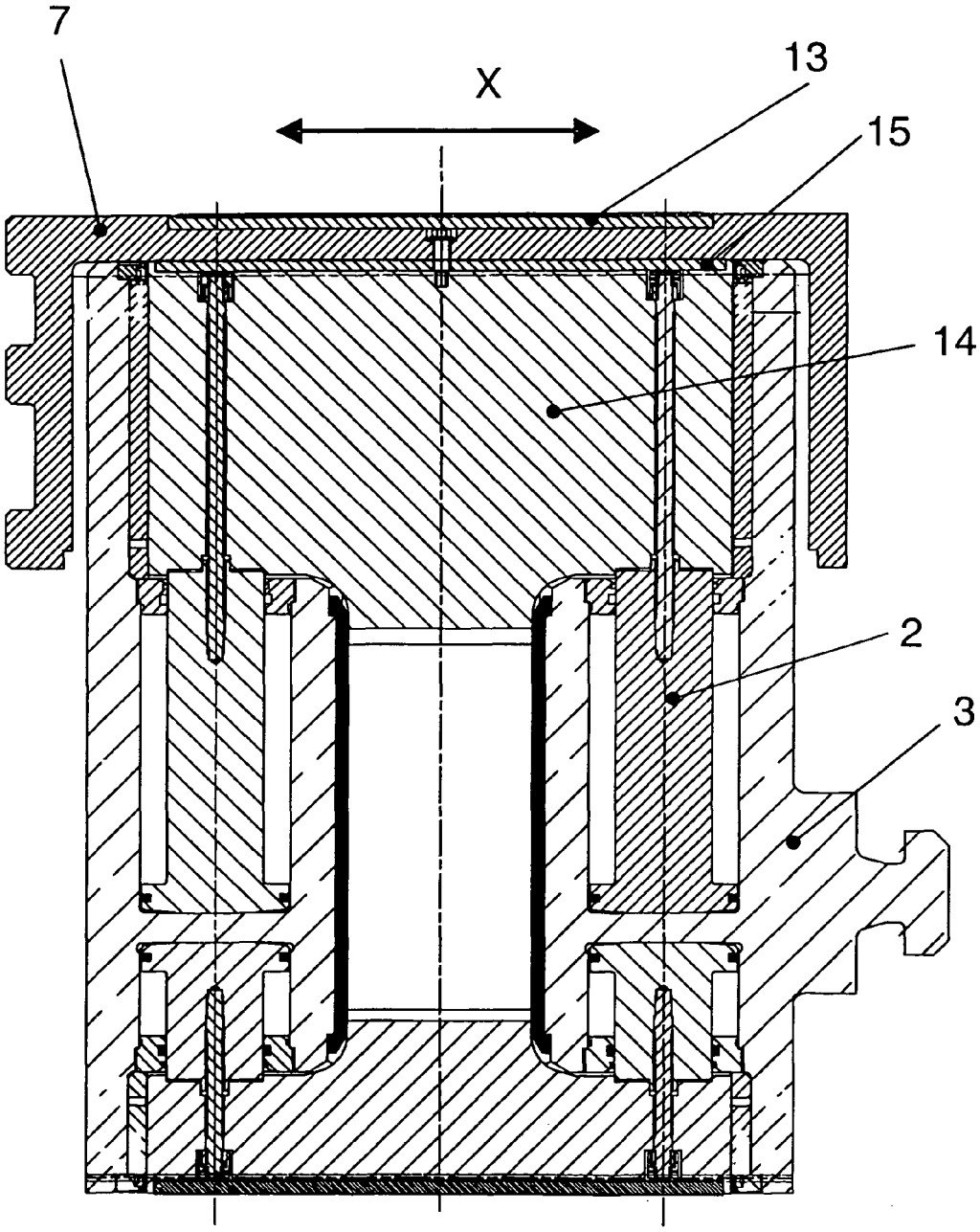
FIG. 4 is a sectional view of the bending device according to the invention depicted in a section plane parallel to the roll axes.

FIG. 4 shows a section drawing of the bending device in a plane parallel to the roll axes of the rolling mill. This special embodiment of the inventive bending device comprises two pistons (2). The bending forces are applied to the thrust piece (14), to the extension piece (7) and finally to the roll chock (5). The forces from the two pistons (2) can be adjusted in accordance to the axial roll position in order to assure that the total resultant force acts on the centreline of the work roll bearing in the roll chocks (5). The left hand side of the depicted roll bending device is positioned inside the mill while the other side is positioned outside of the mill.

The roll chock (5) may slide on the extension (7) changing its position (X). Thus a roll bending device fixed to the rolling mill stand (6) can be used even with large axial shifting of the rolls. Bending can be assured for all axial roll shifting positions. A very reliable and simple rolling mill stand allowing full control of profile and flatness of the rolled material by means of axial shifting and bending is achieved. The extension piece (7) can be designed to be fixed to the bending block (3) or to allow axial movement. Furthermore the extension piece (7) can be used with a bending block (3) which is also axially relocatable. Therefore the design can be adjusted to the specific requirements of the respective rolling mill stand or the mode of operation of the rolling mill stand.

Figure 5:
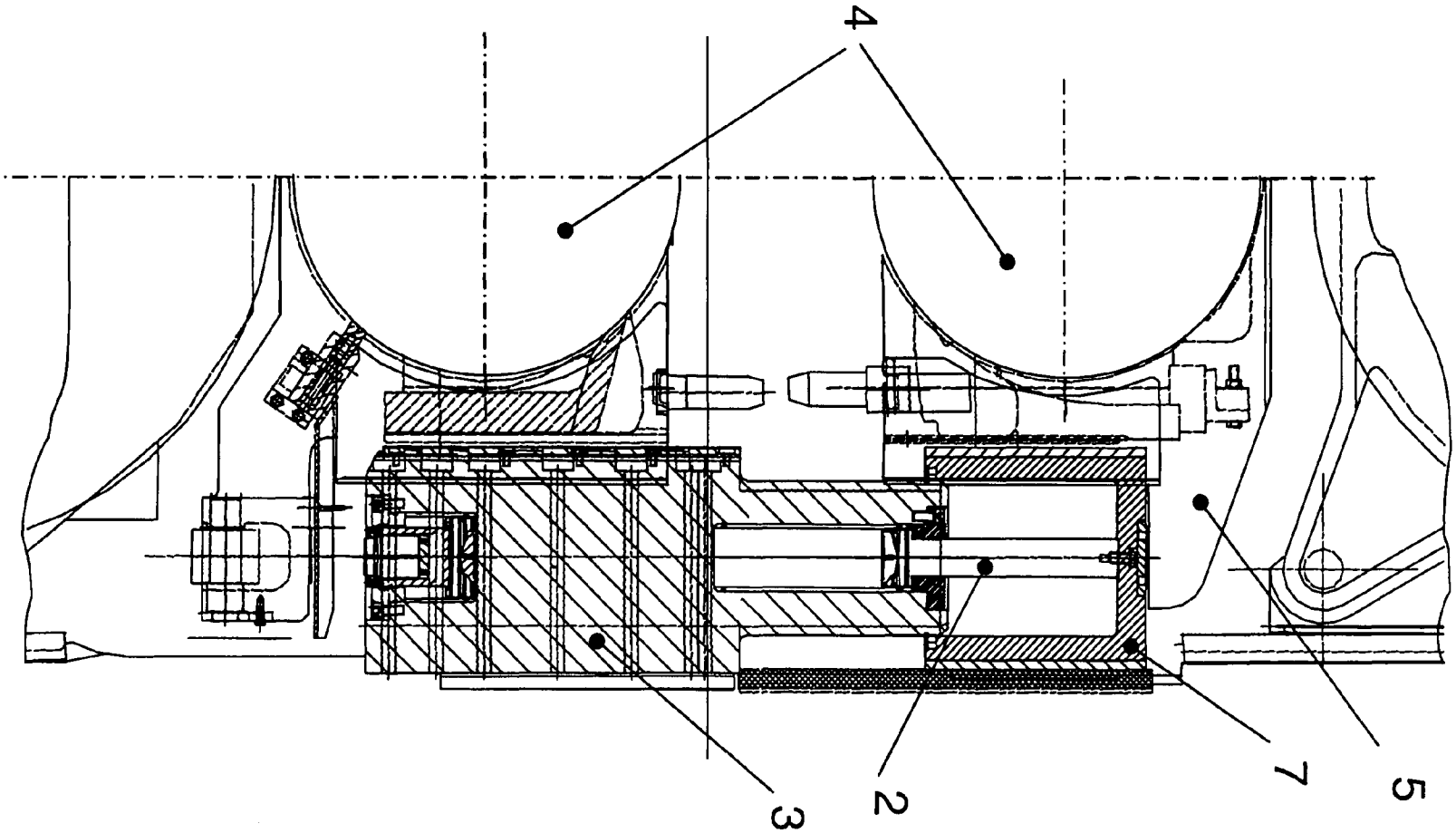
FIG. 5 is a sectional view of an alternative embodiment of the bending device according to the invention.

FIG. 5 shows an alternative embodiment of the bending device. The bending block (3) is fixed to the mill stand housing and is not moved in an axial direction. This design can be used where long stroke bending is required and where there is no axial roll shifting necessary. The extension piece (7) is connected to the piston (2) allowing the transfer of side loads from the roll chock to the mill stand housing even at large roll gauges. The extension piece (7) is fixed to bending block.

Figure 6:
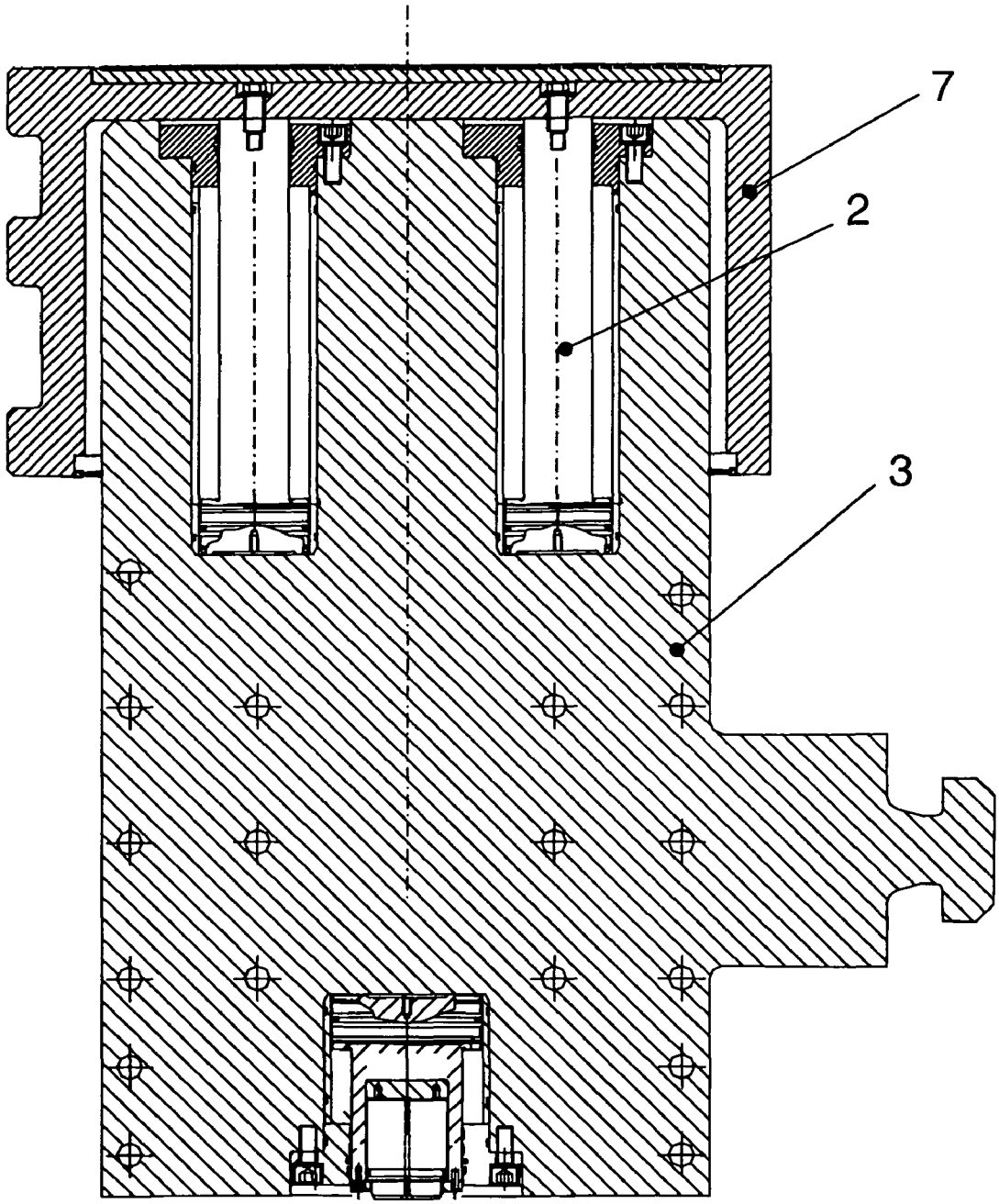
FIG. 6 is a sectional view of an alternative embodiment of the bending device according to the invention depicted in a section plane parallel to the roll axes.

FIG. 6 shows the alternative embodiment of the bending device depicted in a section plane parallel to the roll axes. Two pistons (2) are acting against the extension piece (7) and the roll chocks.

The invention claimed is:

1. A roll bending device configured to bend at least one roll of a pair of cooperating rolls in a strip forming apparatus so as to control profile and flatness in rolling of a metal strip or plate, wherein the strip forming apparatus comprises the pair of cooperating rolls oriented to define profile and flatness of the metal strip or plate as the metal strip or plate passes between the pair of rolls, and wherein each roll is pivoted in respective roll chocks, each roll chock including a vertical face between the role and a bending block, and the roll chocks are positioned in a mill stand housing, the roll bending device comprising:

the bending block extending between the roll chocks of the pair of cooperating rolls;

a piston positioned in the bending block and having a minimum extension stroke and a maximum extension stroke, the piston configured to adjust spacing between the roll chocks by movement of the piston, so as to control the profile and flatness of the metal strip or plate;

an extension piece including a top part, a first side wall positioned between the bending block and the vertical face of the roll chock, and a second side wall positioned between the bending block and the mill stand housing, the extension piece connected to the bending block, the extension piece positioned to be guided and moved between the vertical face of the roll chocks and the mill stand housing, and the extension piece being configured to be moved with respect to the roll chock;

the extension piece being configured and operable to transfer side loads from the roll chock to the mill stand housing, and the first side wall and the second side wall of the extension piece encompassing at least part of the bending block even at the maximum extension stroke of the piston.

2. The roll bending device of claim 1, wherein the piston of the bending block has a piston motion axis, and the extension piece is configured to be relocated in a direction parallel to the axis of the piston motion for allowing transfer of bending forces from the roll bending block to the roll chock.

3. The roll bending device of claim 1, wherein the first and second side walls of the extension piece are arranged and oriented parallel to respective axes of the rolls, and the extension piece side walls are in contact with the roll chock and with the mill stand housing.

4. The roll bending device of claim 3, wherein the first and second side walls of the extension piece respectively comprise a wear plate at the roll chock and a wear plate at the mill stand housing.

5. The roll bending device of claim 4, further comprising a wear plate positioned at the roll chock and a wear plate positioned at the mill stand housing, wherein the wear plates of the first and second side walls of the extension piece at the roll chock and at the mill stand housing are removably mounted to the respective wear plates of the roll chock and the mill stand housing.

6. The roll bending device of claim 4, further comprising a respective wear plate removably mounted on the roll chock for cooperating with the wear plate of the first side wall of the extension piece and a removably mounted wear plate on the mill stand housing in engagement with the wear plate of the second side wall of the extension piece.

7. The roll bending device of claim 3, the top part of the extension piece comprising a removably mounted wear plate configured and positioned to be brought into contact with the roll chock of one of the rolls at which the extension piece is located.

8. The roll bending device of claim 1, wherein the bending block further includes a thrust piece configured to transfer a roll bending force generated by the piston of the bending block to the extension piece.

9. The roll bending device of claim 8, wherein the thrust piece is connected to the piston.

10. The roll bending device of claim 8, wherein the thrust piece includes a removably mounted wear plate operable for contacting the extension piece.

11. The roll bending device of claim 1, wherein the extension piece which is supported at the bending block and at the mill stand housing, and the roll, and the extension piece are movable in an axial direction along the axis of a respective roll at the roll chock where the extension piece is located.

12. The roll bending device of claim 11, wherein the extension piece and the bending block are operable for movement in an axial direction along the axis of the roll having a chock at which the extension piece is located, and the roll is movable in the axial direction, and the bending block operates as a guiding device for being guidable in an axial direction.

13. The roll bending device of claim 11, wherein an axial position of the roll having the chock at which the extension piece is located is adjustable;

the bending block includes at least the piston and a second piston at a location axially different from a location of the piston with respect to an axial direction of the roll at which the chock is located, wherein the pistons are operable so that bending force applied by at least one of the pistons is adjustable according to an axial position of the roll to apply a force based on the axial position of the roll for keeping a resulting total bending force centered on the roll chock.

14. The roll bending device of claim 12, further comprising a second roll bending device positioned and operable to act on each of the roll chocks.

15. In combination, the roll bending device of claim 1 and a rolling mill stand, comprising:

a stand housing;

at least a pair of cooperating rolls for the rolling mill stand housing, a respective set of roll chocks for each roll of the at least a pair of cooperating rolls, the roll chocks are configured to control profile and flatness of a rolling metal strip or plate; and wherein the rolls are pivoted in the respective roll chocks, and the roll bending device is supported at the mill stand and at one of the chocks of one of the rolls.

16. The rolling mill stand of claim 15, wherein the first and second side walls of the extension piece respectively comprise a removably mounted wear plate at the roll chock and a removably mounted wear plate at the mill stand housing.

17. The rolling mill stand of claim 15, wherein the extension piece and the roll at the extension piece are movable in the mill stand housing in an axial direction along the axis of the respective roll at the roll chock where the extension piece is located.

18. The rolling mill stand of claim 15, wherein the bending block, the extension piece and the roll at the extension piece are operable for movement in an axial direction in the mill stand housing along an axis of the roll having the roll chock at which the extension piece is located.

19. The rolling mill stand of claim 15, wherein communication between the roll chock and the extension piece permits relative axial displacement of the roll along the axis thereof with respect to the extension piece.

20. The rolling mill stand of claim 14, wherein each of the rolls has a respective roll chock at each end of the roll, and a respective bending device acting at each of the roll chocks at the opposite ends of the rolls.

21. The roll bending device of claim 1, wherein the extension piece comprises a third side wall and a fourth side wall such that the extension piece has a box shaped design.

* * * * *